US011201048B2

(12) United States Patent
Langridge et al.

(10) Patent No.: US 11,201,048 B2
(45) Date of Patent: Dec. 14, 2021

(54) QUADRUPOLE DEVICES

(71) Applicant: MICROMASS UK LIMITED, Wilmslow (GB)

(72) Inventors: David J. Langridge, Macclesfield (GB); Martin Raymond Green, Bowdon (GB)

(73) Assignee: Micromass UK Limited, Wilmslow (GB)

( * ) Notice: Subject to any disclaimer, the term of this patent is extended or adjusted under 35 U.S.C. 154(b) by 4 days.

(21) Appl. No.: 16/330,705

(22) PCT Filed: Sep. 6, 2017

(86) PCT No.: PCT/GB2017/052587
§ 371 (c)(1),
(2) Date: Mar. 5, 2019

(87) PCT Pub. No.: WO2018/046906
PCT Pub. Date: Mar. 15, 2018

(65) Prior Publication Data

US 2020/0161121 A1 May 21, 2020

(30) Foreign Application Priority Data

Sep. 6, 2016 (GB) ..... 1615127

(51) Int. Cl.
*H01J 49/42* (2006.01)
*H01J 49/02* (2006.01)

(52) U.S. Cl.
CPC ..... *H01J 49/4225* (2013.01); *H01J 49/022* (2013.01); *H01J 49/427* (2013.01); *H01J 49/4265* (2013.01)

(58) Field of Classification Search
CPC .. H01J 49/022; H01J 49/0027; H01J 49/4225; H01J 49/424; H01J 49/426; H01J 49/427; H01J 49/428; H01J 49/4265
See application file for complete search history.

(56) References Cited

U.S. PATENT DOCUMENTS 5,089,703 A * 2/1992 Schoen ..... H01J 49/4285 250/281
5,177,359 A 1/1993 Hiroki et al.
(Continued)

FOREIGN PATENT DOCUMENTS

CN 103250229 A 8/2013
CN 105097414 A 11/2015
(Continued)

OTHER PUBLICATIONS

Du, Zhaohui, D. J. Douglas, and Nikolai Konenkov. "Elemental analysis with quadrupole mass filters operated in higher stability regions." Journal of Analytical Atomic Spectrometry 14.8 (1999): 1111-1119 (Year: 1999).*
(Continued)

*Primary Examiner* — Wyatt A Stoffa
(74) *Attorney, Agent, or Firm* — Kacvinsky Daisak Bluni PLLC

(57) ABSTRACT

A method of operating a quadrupole device is disclosed that comprises operating the quadrupole device in a first mode of operation, and operating the quadrupole device in a second mode of operation. Operating the quadrupole device in the first mode of operation comprises applying one or more first voltages to the quadrupole device such that the quadrupole device is operated in an initial stability region and such that at least some ions are stable within the quadrupole device. Operating the quadrupole device in the second mode of operation comprises applying one or more second voltages to the quadrupole device such that the quadrupole device is
(Continued)

operated in a different stability region and such that at least some of the ions that were stable within the quadrupole device in the first mode of operation are stable within the quadrupole device in the second mode of operation.

20 Claims, 7 Drawing Sheets

(56) References Cited

U.S. PATENT DOCUMENTS 5,298,746 A * 3/1994 Franzen ..... H01J 49/429 250/282
5,347,127 A * 9/1994 Franzen ..... H01J 49/424 250/282
8,742,330 B2 * 6/2014 Taniguchi ..... H01J 49/424 250/281
10,825,676 B2 * 11/2020 Jiang ..... H01J 49/062
2002/0005479 A1 * 1/2002 Yoshinari ..... H01J 49/424 250/288
2004/0108456 A1 * 6/2004 Sudakov ..... H01J 49/4225 250/288
2004/0232328 A1 * 11/2004 Ding ..... H01J 49/0068 250/292
2009/0032698 A1 * 2/2009 Furuhashi ..... H01J 49/0063 250/282
2009/0230301 A1 * 9/2009 Furuhashi ..... H01J 49/4265 250/282
2010/0237237 A1 * 9/2010 Green ..... H01J 49/427 250/283
2012/0049059 A1 * 3/2012 Taniguchi ..... H01J 49/424 250/290
2012/0119083 A1 * 5/2012 Kodera ..... G01N 27/626 250/290
2012/0292499 A1 * 11/2012 Taniguchi ..... H01J 49/424 250/286
2013/0234018 A1 * 9/2013 Mizutani ..... H01J 49/28 250/294
2014/0166895 A1 * 6/2014 Kenny ..... H01J 49/065 250/396 R
2014/0284469 A1 * 9/2014 Langridge ..... H01J 49/36 250/282
2014/0346344 A1 * 11/2014 Chen ..... H01J 49/36 250/283
2016/0181076 A1 * 6/2016 Smith ..... H01J 49/0009 702/104
2017/0110311 A1 * 4/2017 Reilly ..... H01J 49/401
2018/0122627 A1 * 5/2018 Guna ..... H01J 49/063
2018/0277350 A1 * 9/2018 Jarrold ..... H01J 49/0031
2019/0162697 A1 * 5/2019 Okumura ..... H01J 49/429
2019/0371587 A1 * 12/2019 Berdnikov ..... H01J 49/062
2020/0027714 A1 * 1/2020 Jiang ..... H01J 49/426
2020/0203142 A1 * 6/2020 Langridge ..... H01J 49/0031

FOREIGN PATENT DOCUMENTS

CN 105849856 A 8/2016
JP H0982274 A 3/1997
WO 2001/29875 A2 4/2001
WO 2009/009471 A2 1/2009
WO 2009/009475 A2 1/2009

OTHER PUBLICATIONS

Cheung, Kerry, Luis Fernando Velasquez-Garcia, and Akintunde Ibitayo Akinwande. "Chip-scale quadrupole mass filters for portable mass spectrometry." Journal of microelectromechanical systems 19.3 (2010): 469-483 (Year: 2010).*
Search Report under Section 17(5) for GB Application No. GB1615127.6 dated Jan. 31, 2017, 4 pages.
Combined Search and Examination Report under Sections 17 and 18(3) for GB Application No. GB1714278.7 dated Mar. 7, 2018, 7 pages.
International Search Report and Written Opinion for International Application No. PCT/GB2017/052587 dated Nov. 17, 2017, 15 pages.
Lee et al., "Stability of Ion Motion in the Quadrupole Ion Trap Driven by Rectangular Waveform Voltages", International Journal of Mass Spectrometry, Elsevier, pp. 65-70, Nov. 1, 2003.
Titov et al., Detailed Study of the Quadrupole Mass Analyzer Operating within the First, Second, and Third (Intermediate) Stability Regions. II. Transmission and Resolution, Journal of the American Society for Mass Spectrometry, Elsevier Science Inc., 9(1):70-87, Jan. 1, 1998.
Communication pursuant to Article 94(3) EPC, for Application No. EP17767877.8, dated Nov. 12, 8 pages.
Ying, J-F, et al., "High Resolution Inductively Coupled Plasma Mass Spectra with a Quadrupole Mass Fiilter", Rapid Communications in Mass Spectrometry, 10(6):649-652 (1996). Abstract.
Douglas, D.J., "Linear quadrupoles in mass spectrometry" Mass Spectrometry Reviews 28(6):937-960 (2009). Abstract.
Brabeck, G.F., et al., "Characterization of quadrupole mass filters operated with frequency-asymmetric and amplitude-asymmetric waveforms", International Journal of Mass Spectrometry, 404:8-13 (2016). Abstract.
Brabeck, G.F., et al., "Development of MSn in Digitally Operated Linear Ion Guides", Analytical Chemistry 86 (15):7757-7762 (2014). Abstract.

* cited by examiner

QUADRUPOLE DEVICES

CROSS-REFERENCE TO RELATED APPLICATION

This application is a national phase filing claiming the benefit of and priority to International Patent Application No. PCT/GB2017/052587, filed on Sep. 6, 2017, which claims priority from and the benefit of United Kingdom patent application No. 1615127.6 filed on Sep. 6, 2016. The entire contents of these applications are incorporated herein by reference.

FIELD OF THE INVENTION

The present invention relates generally to quadrupole devices and analytical instruments such as mass and/or ion mobility spectrometers that comprise quadrupole devices, and in particular to quadrupole ion traps, linear ion traps and quadrupole mass filters and analytical instruments that comprise quadrupole ion traps, linear ion traps and quadrupole mass filters.

BACKGROUND

Quadrupole devices such as quadrupole ion traps, linear ion traps and quadrupole mass filters comprise a set of plural electrodes.

In operation, one or more drive voltages are applied to the electrodes of the quadrupole device so that ions having mass to charge ratios within a desired mass to charge ratio range will be retained within the device and/or onwardly transmitted by the device. Ions having mass to charge ratio values outside of the mass to charge ratio range will be lost and/or substantially attenuated.

The drive voltages are selected such that the quadrupole device is operated in one of one or more so-called "stability regions", i.e. such that at least some ions will assume a stable trajectory in the quadrupole device. It is common for quadrupole devices to be operated in the so-called "first" (i.e. lowest order) stability region.

Operation of quadrupole devices in higher-order stability regions (i.e. in stability regions other than the first stability region) can be desirable and can be beneficial. For example, operation in higher stability regions can reduce the numbers of RF cycles that are required in order to achieve a given resolution. Operation in higher stability regions can also bring improvements in peak shape.

However, it can be difficult to obtain high ion transmission into and/or through a quadrupole device when it is operated in a higher-order stability region. In the case of quadrupole mass filters and linear ion traps, this is because of the low acceptance, and the highly divergent fringing fields that are produced when operating in these regions. In the case of quadrupole ion traps, this is because of the low trapping efficiency when operating in these regions.

Various approaches to improving transmission into and/through quadrupole mass filters have been proposed, such as the use of Brubaker lenses, phased locked RF lenses, and high energy injection.

Brubaker lenses can be an effective solution when a quadrupole mass filter is operated in the first stability region. However, for higher stability regions there is no continuously stable path across the stability diagram, and so they cannot be used for operation in higher stability regions.

Phase locked RF lenses attempt to modulate the input ion conditions to better match the acceptance ellipse as it changes across the phases of the RF cycle. However, while they attempt to increase the transmission through a quadrupole mass filter, they do not directly address the issue of fringing fields.

High energy injection techniques attempt to increase transmission by reducing the number of RF cycles ions spend in the fringing field region. However, this approach is disadvantageous as it reduces the number of RF cycles seen by the ions within the quadrupole mass filter itself, leading to reduced resolution.

It is desired to provide an improved quadrupole device.

SUMMARY

According to an aspect, there is provided a method of operating a quadrupole device comprising:

operating the quadrupole device in a first mode of operation; and operating the quadrupole device in a second mode of operation;

wherein operating the quadrupole device in the first mode of operation comprises applying one or more first voltages to the quadrupole device such that the quadrupole device is operated in an initial stability region and such that at least some ions are stable within the quadrupole device; and wherein operating the quadrupole device in the second mode of operation comprises applying one or more second voltages to the quadrupole device such that the quadrupole device is operated in a different stability region and such that at least some of the ions that were stable within the quadrupole device in the first mode of operation are stable within the quadrupole device in the second mode of operation.

Various embodiments described herein are directed to methods of operating a quadrupole device in which the device is operated in a first mode of operation in which at least some ions within the quadrupole device are stable with respect to an initial stability region, and is then operated in a second mode of operation in which at least some of the ions that were stable with respect to the initial stability region are stable with respect to a different stability region.

The Applicants have recognised that it is possible to switch a quadrupole device between operating in different (e.g. different order) stability regions while at least some ions within the device maintain stable trajectories and are therefore retained (i.e. radially or otherwise confined) within the device, and moreover that this can be beneficial.

For example, according to various embodiments, the initial stability region may comprise a lower-order stability region such as the first stability region (i.e. the lowest order stability region), and the different stability region may comprise a higher stability region (e.g. a stability region other than the first stability region). Ions may be passed into the quadrupole device or generated in the quadrupole device when the device is operated in the first mode of operation.

In this way, ions may be introduced to the quadrupole device when it is operated in a lower-order stability region, i.e. such that the acceptance of ions in and/or trapping efficiency of ions in and/or transmission of ions into and/or through the quadrupole device may be relatively high, and then the quadrupole device may be switched to operate in a higher-order stability region, e.g. once the ions are inside and stable in the quadrupole device. Thus, the ions may be introduced to the quadrupole device while experiencing a relatively increased acceptance and/or trapping efficiency and/or reduced fringe field, but may then be subjected to the quadrupolar field of a higher-order stability region (which may have a relatively reduced acceptance and/or trapping efficiency and/or increased fringe field, but which may be otherwise useful and beneficial, as discussed above).

Accordingly, the acceptance and/or trapping efficiency and/or transmission of ions into the device can be improved, e.g. when it is desired to operate the device in a higher order stability region.

It will be appreciated, therefore, that the present invention provides an improved quadrupole device.

The method may comprise passing ions into the quadrupole device and/or generating ions in the quadrupole device when the quadrupole device is operated in the first mode of operation.

The one or more first and/or second voltages may comprise one or more digital drive voltages.

The one or more first voltages may comprise a first repeating (RF) voltage waveform.

The first voltage waveform may have one or more first amplitudes, a first frequency, a first shape and/or a first duty cycle.

The one or more second voltages may comprise a second repeating voltage waveform.

The second voltage waveform may have one or more second amplitudes, a second frequency, a second shape and/or a second duty cycle.

One or more or all of the first and second amplitudes, the first and second frequencies, the first and second shapes and the first and second duty cycles may be different.

One or more of the first and second amplitudes may be substantially the same.

The phase of the first voltage waveform at which the one or more first voltages are ended and/or at which the one or more second voltages are initiated may be selected in order to increase ion retention in and/or ion transmission through the quadrupole device.

The phase of the second voltage waveform at which the one or more first voltages are ended and/or at which the one or more second voltages are initiated may be selected in order to increase ion retention in and/or ion transmission through the quadrupole device.

The method may comprise applying one or more constant DC voltages, one or more focussing pulses, and/or one or more defocussing pulses to the quadrupole device after applying the one or more first voltages and before applying the one or more second voltages.

The different stability region may be a higher order stability region than the initial stability region.

The quadrupole device may comprise a quadrupole ion trap, a linear ion trap or a quadrupole mass filter.

The one or more first and/or second voltages may comprise one or more quadrupolar repeating voltage waveforms, optionally together with one or more dipolar repeating voltage waveforms.

According to an aspect there is provided apparatus comprising:

a quadrupole device; and a control system;

wherein the control system is configured:

(i) to operate the quadrupole device in a first mode of operation; and (ii) to operate the quadrupole device in a second mode of operation;

wherein the control system is configured to operate the quadrupole device in the first mode of operation by applying one or more first voltages to the quadrupole device such that the quadrupole device is operated in an initial stability region and such that at least some ions are stable within the quadrupole device; and wherein the control system is configured to operate the quadrupole device in the second mode of operation by applying one or more second voltages to the quadrupole device such that the quadrupole device is operated in a different stability region and such that at least some of the ions that were stable within the quadrupole device in the first mode of operation are stable within the quadrupole device in the second mode of operation.

The control system may be configured to cause ions to be passed into the quadrupole device and/or to cause ions to be generated in the quadrupole device when the quadrupole device is operated in the first mode of operation.

The one or more first and/or second voltages may comprise one or more digital drive voltages.

The one or more first voltages may comprise a first repeating (RF) voltage waveform.

The first voltage waveform may have one or more first amplitudes, a first frequency, a first shape and/or a first duty cycle.

The one or more second voltages may comprise a second repeating voltage waveform.

The second voltage waveform may have one or more second amplitudes, a second frequency, a second shape and/or a second duty cycle.

One or more or all of the first and second amplitudes, the first and second frequencies, the first and second shapes and the first and second duty cycles may be different.

One or more of the first and second amplitudes may be substantially the same.

The phase of the first voltage waveform at which the one or more first voltages are ended and/or at which the one or more second voltages are initiated may be selected in order to increase ion retention in and/or ion transmission through the quadrupole device.

The phase of the second voltage waveform at which the one or more first voltages are ended and/or at which the one or more second voltages are initiated may be selected in order to increase ion retention in and/or ion transmission through the quadrupole device.

The control system may be configured to apply one or more constant DC voltages, one or more focussing pulses, and/or one or more defocussing pulses to the quadrupole device after applying the one or more first voltages and before applying the one or more second voltages.

The different stability region may be a higher order stability region than the initial stability region.

The quadrupole device may comprise a quadrupole ion trap, a linear ion trap or a quadrupole mass filter.

The one or more first and/or second voltages may comprise one or more quadrupolar repeating voltage waveforms, optionally together with one or more dipolar repeating voltage waveforms.

According to an aspect, there is provided a quadrupole device, wherein in operation:

the device is driven with a digital pulsed waveform;

ions are introduced to the device and/or generated within the device;

the initial voltage amplitude and/or waveform and/or duty cycle and/or frequency of the drive voltage is selected such that ions of interest are introduced and/or created in a first stable region of the stability diagram of the (first) drive voltage; and after some time, one, some or all of the voltage amplitude and/or waveform and/or duty cycle and/or frequency of the drive voltage is or are altered so as to place the ions of interest in a different stable region of the stability diagram of the (second) drive voltage.

The quadrupole device may comprise a quadrupole ion trap, a linear ion trap, or a quadrupole mass filter.

The pulse voltage amplitude or amplitudes may be kept constant.

The end and/or start phases of the first and second waveforms may be selected so as to increase or maximise transmission.

The method may comprise applying zero voltage and/or a focusing pulse and/or a sequence of pulses in either (x or y) axis, e.g. for a short duration.

According to an aspect there is provided an analytical instrument comprising a quadrupole device as described above.

The analytical instrument may comprise a mass and/or ion mobility spectrometer.

The spectrometer may comprise an ion source. The ion source may be selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells. The one or more collision, fragmentation or reaction cells may be selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise one or more mass analysers. The one or more mass analysers may be selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Various embodiments are directed to a method of operating a quadrupole device. The quadrupole device may comprise a 3D quadrupole ion trap, a 2D linear ion trap, a quadrupole mass filter, or another quadrupole device.

Figure 1A:
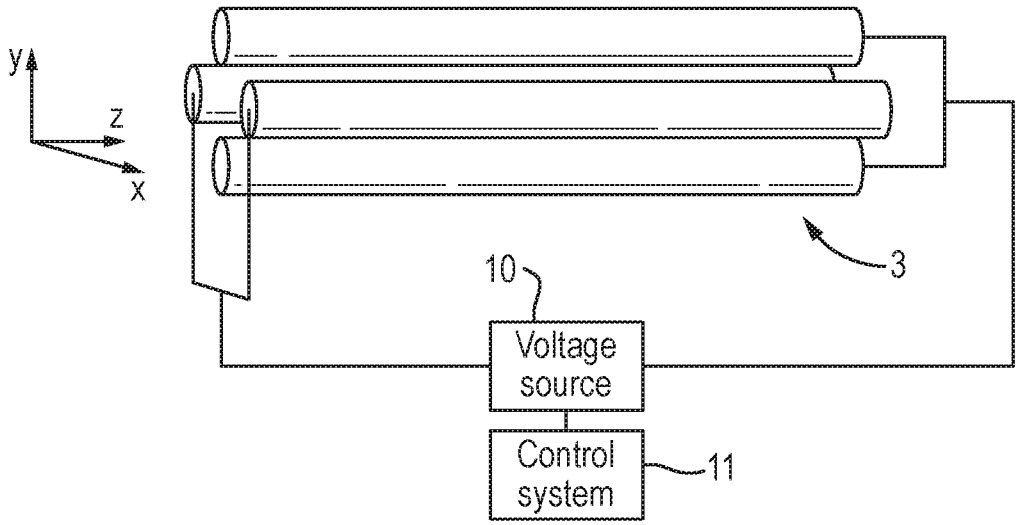
FIGS. 1A and 1B show schematically quadrupole devices in accordance with various embodiments.

As illustrated schematically in FIG. 1A, the quadrupole device 3 (e.g. linear ion trap or quadrupole mass filter) may comprise four electrodes, e.g. rod electrodes, which may be arranged to be parallel to one another. The quadrupole device may comprise any suitable number of other electrodes (not shown). The rod electrodes may be arranged so as to surround a central axis of the quadrupole (z-axis) and to be parallel to the axis (parallel to the axial- or z-direction).

Figure 1B:
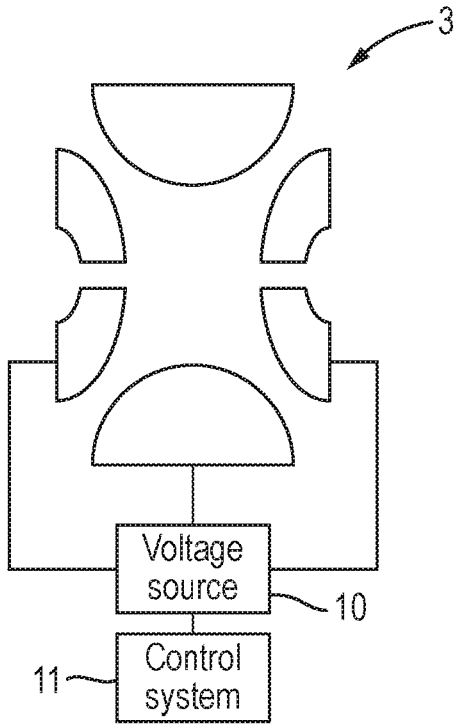

Alternatively, as illustrated schematically in FIG. 1B, the quadrupole device 3 (e.g. quadrupole ion trap) may comprise three electrodes, e.g. a ring electrode and two "end-cap" electrodes. The quadrupole device may comprise any suitable number of other electrodes (not shown).

Other arrangements for the quadrupole device 3 would be possible.

In operation, one or more drive voltages may be applied to the electrodes of the quadrupole device 3, e.g. by a voltage source 10, such that ions within the quadrupole device having mass to charge ratios within a desired mass to charge ratio range will assume stable trajectories (i.e. will be radially or otherwise confined) within the quadrupole device, and will therefore be retained within the device and/or onwardly transmitted by the device. Ions having mass to charge ratio values outside of the mass to charge ratio range will assume unstable trajectories in the quadrupole device, and will therefore be lost and/or substantially attenuated.

The one or more drive voltages may comprise any suitable drive voltage(s) that will have the effect of causing at least some ions to be retained (e.g. radially or otherwise confined) within the quadrupole device. The drive voltage may comprise a repeating voltage waveform, and may be applied to any one or more of the electrodes of the quadrupole device in any suitable manner.

The repeating voltage waveform may comprise an RF voltage optionally together with a DC offset voltage. Alternatively, the repeating voltage waveform may comprise a square or rectangular waveform. It would also be possible for the repeating voltage waveform to comprise a pulsed EC waveform, a three phase rectangular waveform, a triangular waveform, a sawtooth waveform, a trapezoidal waveform, and the like.

As shown in FIG. 1A, each pair of opposing electrodes of the quadrupole device 3 of FIG. 1A may be electrically connected and/or may be provided with the same drive voltage(s). A first phase of the voltage waveform may be applied to one of the pairs of opposing electrodes, and the opposite phase of the voltage waveform (180° out of phase) may be applied to the other pair of electrodes. Alternatively, the voltage waveform may be applied to only one of the pairs of opposing electrodes. The amplitude, frequency and/or waveform of the voltage waveform may be selected as desired.

As shown in FIG. 1B, the voltage waveform may be applied to the ring electrode of the quadrupole ion trap. The voltage waveform and/or one or more other voltages may additionally or alternatively be applied to one or both of the end cap electrodes. The amplitude, frequency and/or waveform of the voltage(s) may be selected as desired.

According to various embodiments, the quadrupole device is operated in a first mode of operation, e.g. during a first period of time, and then operated in a second, different, mode of operation, e.g. during a second period of time.

In the first mode of operation, one or more first voltages are applied to the quadrupole device such that the quadrupole device is operated in an initial stability region and such that at least some ions are stable (e.g. are radially or otherwise confined) within the quadrupole device. That is, such that at least some ions within the quadrupole device are stable with respect to the initial stability region, i.e. such that at least some ions assume stable trajectories within the quadrupole device, and are therefore retained within and/or onwardly transmitted by the device.

In the second mode of operation, one or more second, different, voltages are applied to the quadrupole device such that the quadrupole device is operated in a different stability region and such that at least some of the ions that were stable within the quadrupole device in the first mode of operation are stable (e.g. are radially or otherwise confined) within the quadrupole device in the second mode of operation. That is, such that at least some of the ions that were stable with respect to the initial stability region are stable with respect to the different stability region, i.e. such that at least some of the ions maintain stable trajectories within the quadrupole device (but assume different stable trajectories compared to the first mode of operation), and are therefore retained within and/or onwardly transmitted by the device.

The initial stability region may comprise any suitable stability region. The initial stability region may comprise a stability region for which the ion acceptance is relatively high and/or for which the trapping efficiency is relatively high and/or for which the fringing fields are relatively reduced and/or non-divergent (e.g. compared to the different stability region). The initial stability region may comprise a relatively low-order stability region such as the first stability region (i.e. the lowest order stability region). Accordingly, the acceptance and/or trapping and/or transmission of ions into (and therefore through) the quadrupole device when it is operated in the first mode of operation may be relatively increased (e.g. compared to when the device is operated in the second mode of operation).

The different stability region may comprise any suitable stability region, so long as it is different from the initial stability region. The different stability region may comprise a stability region for which the numbers of RF cycles that are required in order to achieve a given resolution is reduced and/or for which peak shape is improved (e.g. compared to the initial stability region).

The different stability region may be different from the initial stability region in that it is a different-order stability region. For example, the different stability region may comprise a relatively high-order stability region (e.g. a stability region other than the first stability region). As discussed above, such stability regions may give rise to relatively low ion acceptance and/or trapping efficiency and/or divergent fringing field (e.g. compared to lower order stability regions such as the first stability region), but may be otherwise useful and beneficial.

The initial and/or different stability region may be selected (i.e. the first and/or second voltages may be selected) such that at least some ions assume stable trajectories within the quadrupole device when the quadrupole device is operated in both the initial stability region and the different stability region, and are therefore retained within and/or onwardly transmitted by the device when the device is sequentially operated in the initial stability region and the different stability region.

As described above, the one or more first voltages that are applied to the quadrupole device may comprise a first repeating (RF) voltage waveform, and/or the one or more second voltages that are applied to the quadrupole device may comprise a second repeating (RF) voltage waveform.

The one or more second voltages that are applied to the quadrupole device in the second mode of operation may be different to the one or more first voltages that are applied to the quadrupole device in the first mode of operation, and may differ in any suitable manner. The one or more second voltages may differ from the one or more first voltages in terms of the amplitude or amplitudes, the frequency, the duty cycle, the shape, and/or the type of the voltage waveform. Accordingly, operating the quadrupole device in the second mode of operation may comprise changing one or more or all of the amplitude or amplitudes, the frequency, the duty cycle, the shape, and/or type of the applied voltage waveform.

Manipulation of the duty cycle of the voltage waveform allows modification of the position of the working point within the stability diagram. Manipulation of the frequency has the effect of moving along the mass to charge ratio ("m/z") scan line.

Varying the pulse voltage amplitude(s) has the effect of moving the working point across the stability region, and allows the operation of the quadrupole device to be moved from any point on the stability diagram to any other point. However, it can be challenging to significantly change the digital pulse voltage quickly, e.g. on the timescale of the (RF) voltage waveform (i.e. from one pulse to the next), e.g. in terms of electronics, etc.

Therefore, according to various embodiments, the applied voltage pulse amplitude(s), i.e. the amplitude or amplitudes of the first and second voltage waveforms, are kept substantially the same. In this case, one or a combination of frequency, duty cycle, and/or waveform manipulation may be used to facilitate transitions across the stability diagram, e.g. while keeping the voltage pulses at fixed amplitude. Thus, according to various embodiments, operating the quadrupole device in the second mode of operation comprises changing one or more or all of the frequency, the duty cycle, the shape, and/or type of the applied voltage waveform.

Additionally or alternatively, any one or more of the frequency, the duty cycle, the shape, and/or type of the applied voltage waveform may be kept constant between the two waveforms (while at least one of the amplitude(s), frequency, the duty cycle, the shape, and/or type of the applied voltage waveform is altered).

According to various embodiments, the at least some ions that are stable with respect to the initial stability region comprise ions of interest, e.g. within a first mass to charge ratio range.

The at least some ions that are stable with respect to the different stability region may comprise ions of interest, e.g. within a second mass to charge ratio range. The second mass to charge ratio range may be the same as the first mass to charge ratio range or may be narrower than the first mass to charge ratio range. The second mass to charge ratio range may be encompassed by the first mass to charge ratio range. The second mass to charge ratio range could also be larger than the first mass to charge ratio range.

Ions may be passed into the quadrupole device and/or may be generated in the quadrupole device while the quadrupole device is operated in the first mode of operation, i.e. while the one or more first voltages are applied to the quadrupole device. As discussed above, at least some or all of the ions that are passed into and/or generated in the quadrupole device may experience a substantially increased acceptance and/or trapping efficiency and/or a substantially reduced fringe field (e.g. compared to when the quadrupole device is operated in the second mode of operation).

The (first) period of time during which the quadrupole device is operated in the first mode of operation may have any suitable duration. The first period of time may be long enough to allow at least some of the ions to cool (e.g. where the quadrupole device is a quadrupole ion trap or linear ion trap). Additionally or alternatively (e.g. where the quadrupole device is a quadrupole mass filter or linear ion trap), the first period of time may be long enough to allow the ions to travel a certain (selected) axial distance (e.g. measured from the entrance of the quadrupole) into the quadrupole device. The certain distance may be selected such that when the quadrupole device is switched to operate in the second mode of operation, the electric field experienced by at least some or all of the ions is substantially identical to a quadrupolar electric field, i.e. ions may be far enough from the entrance of the quadrupole such that fringing field effects are negligible. In various embodiments, the certain distance may be of the order of mm or tens of mm.

The time delay between passing, releasing or generating the ions in the quadrupole device and switching the quadrupole device to operate in the second mode of operation (the duration of the first period of time) may be selected as desired. In various embodiments, the time delay may be of the order of μs, tens of μs, hundreds of μs or thousands of μs.

The ions that are passed into the quadrupole device when the quadrupole device is operated in the first mode of operation may comprise (part of) a beam of ions, e.g. a substantially continuous beam of ions that may e.g. be generated by an ion source or otherwise. Correspondingly, ions that are generated in the quadrupole device may be continuously generated. In these embodiments, the ions that are introduced to the quadrupole device when the quadrupole device is operated in the second mode of operation may experience a relatively low acceptance into and/or trapping efficiency in and/or transmission through the quadrupole device, but ions that are introduced to the quadrupole device when the quadrupole device is operated in the first mode of operation may experience a relatively high acceptance into and/or trapping efficiency in and/or transmission through the quadrupole device. Accordingly, in these embodiments the overall acceptance and/or trapping efficiency and/or transmission of ions in the quadrupole device is increased.

In these embodiments, the switching of the quadrupole device between the first and second modes of operation may be controlled in dependence on the composition of the ions. For example, if it is known or expected that ions of interest will be present during a particular period of time, then the quadrupole device may be operated in the first (high acceptance/trapping/transmission) mode of operation when the ions of interest are introduced to the quadrupole device.

According to various other embodiments, the ions that are introduced to the quadrupole device when the quadrupole device is operated in the first mode of operation may comprise one or more packets or discrete groups of ions. In this case, each packet of ions may be introduced to the quadruple device when the quadrupole device is operated in the first (high acceptance/trapping/transmission) mode of operation, i.e. during a or the first period of time. This may increase duty cycle, e.g. since the quadrupole device may be operated such that at least some or each packet of ions experiences a relatively high acceptance and/or trapping efficiency and/or reduced fringing fields. For example, ions may (always) be introduced to the quadrupole device when the quadrupole device is operated in the first mode of operation.

In these embodiments, a packet of ions may be accumulated or trapped, e.g. from a beam of ions or otherwise, and then the packet of ions may be passed into the quadrupole device when the quadrupole device is operated in the first mode of operation.

The ions may be accumulated in an ion trap or other accumulation or trapping region. Accordingly, in various embodiments an ion trap or trapping region may be provided, e.g. upstream of the quadrupole device. A packet of ions may be released from the ion trap or trapping region when the quadrupole device is operated in the first mode of operation. Accordingly, a packet of ions may be passed into the quadrupole device such that the ions experience a substantially increased acceptance and/or trapping efficiency and/or reduced fringe field.

In these embodiments, ions may be accumulated in the ion trap or trapping region when the quadrupole device is operated in the second mode of operation (during the second period of time), i.e. while another packet of ions is within the quadrupole device.

Once ions have been passed into or generated in the quadrupole device, then the quadrupole device may be switched to operate in the second mode of operation, i.e. the one or more second voltages may be applied to the electrodes of the quadrupole device. Thus, according to various embodiments, the second period of time may immediately follow the first period of time.

The second period of time during which the quadrupole device is operated in the second mode of operation may have any suitable duration. The second period of time may be long enough to allow at least some of the ions to cool. Additionally or alternatively, the second period of time may be long enough to allow at least some or all of the ions (e.g. packet of ions), or at least some or all ions of interest (e.g. ions having a mass to charge ratio ("m/z") range of interest) to be analysed by and/or to pass through (and to be selected and/or filtered by) the quadrupole device.

Once at least some of all of the ions (e.g. packet of ions), or at least some or all ions of interest (e.g. ions having a mass to charge ratio ("m/z") range of interest) have been analysed by and/or have passed through the quadrupole device (i.e.

have exited the quadrupole device), then the quadrupole device may be switched back to the first mode of operation.

More ions, e.g. a further packet of ions, may then be introduced into and/or generated in the quadrupole device, i.e. while experiencing an increased acceptance and/or trapping efficiency and/or a reduced fringe field.

This operation may be repeated multiple times, i.e. the quadrupole device may be switched multiple times between the first and second modes of operation, and ions may be passed into and/or generated in the quadrupole device during some or each of the time periods during which the quadrupole device is operated in the first mode of operation.

Thus, according to various embodiments, the method comprises operating the quadrupole device in the second mode of operation, and then operating the quadrupole device in the first mode of operation, and then operating the quadrupole device in the second mode of operation (and so on). During each time period when the quadrupole device is operated in the second mode of operation, ions may be accumulated or trapped, and then each accumulated packet of ions may be passed into the quadrupole device during each subsequent time period in which the quadrupole device is operated in the first mode of operation. This has the effect of increasing duty cycle.

According to various embodiments, the one or more first and/or second voltages are digitally applied, that is, the one or more first and/or second voltages may comprise one or more digital drive voltages, and the voltage source 10 may comprise a digital voltage source. The digital voltage source may be configured to supply the one or more drive voltages to the electrodes of the quadrupole device. As will be described in more detail below, the use of a digital drive voltage according to various embodiments facilitates increased flexibility in the operation of the quadrupole device, and e.g. facilitates precise and substantially instantaneous control over changing and/or initiating the one or more drive voltages.

As shown in FIGS. 1A and 1B, according to various embodiments, a control system 11 may be provided. The voltage source 10 may be controlled by the control system 11 and/or may form part of the control system 11. The control system may be configured to control the operation of the quadrupole device 3 and/or voltage source 10, e.g. in the manner of the various embodiments described herein. The control system 10 may comprise suitable control circuitry that is configured to cause the quadrupole device 3 and/or voltage source 10 to operate in the manner of the various embodiments described herein. The control system may also comprise suitable processing circuitry configured to perform any one or more or all of the necessary processing and/or post-processing operations in respect of the various embodiments described herein.

It will be appreciated that various embodiments are directed to a method of quadrupolar stability region jumping. Manipulation of the applied drive voltage according to various embodiments allows instantaneous "jumping" across different stability regions. This can be done in a number of ways, including changing one, some or all of: the pulse voltage amplitude(s), frequency, duty cycle, and the applied RF waveform.

Various embodiments are directed to a quadrupole device such as a quadrupole ion trap, linear ion trap, or quadrupole mass filter, wherein in operation a drive voltage is applied to the device.

Ions are introduced to the device and/or generated within the device when a first drive voltage is applied to the device such that the ions of interest (e.g. having a mass to charge ratio within a range of interest) are introduced and/or created in a first stable region of the stability diagram of the first drive voltage. The drive voltage may cause ions to be radially confined within the device and/or to be selected or filtered according to their mass to charge ratio.

After some time one, some or all of the voltage amplitude, waveform, duty cycle, and/or frequency of the drive voltage is/are altered so as to place the ions of interest in a different stable region of the stability diagram of the second drive voltage. The second drive voltage may cause ions to be radially confined within the device and/or to be selected or filtered according to their mass to charge ratio.

In embodiments where the techniques described herein are applied in an ion trap (e.g. 3D or linear trap) some cooling time may be provided before and after stability region transitions. For example, ions may be introduced to the trap in one stability region, allowed to cool, then jumped to a higher stability region, allowed to cool once more, and then e.g. analysed (by any suitable and desired method). This will have the effect of increasing ion retention within the device.

In embodiments where the techniques described herein are applied to a quadrupole mass filter, the transition may be applied while the ions are in transit through the quadrupole device. In this case, the ions may be injected in packets. The transition may be applied once the ions have moved far enough into the quadrupole that the field is substantially identical to the 2D quadrupolar field, i.e. ions are far enough from the entrance of the quadrupole that fringing field effects are negligible. This will have the effect of increasing ion retention within the device.

Figure 2:
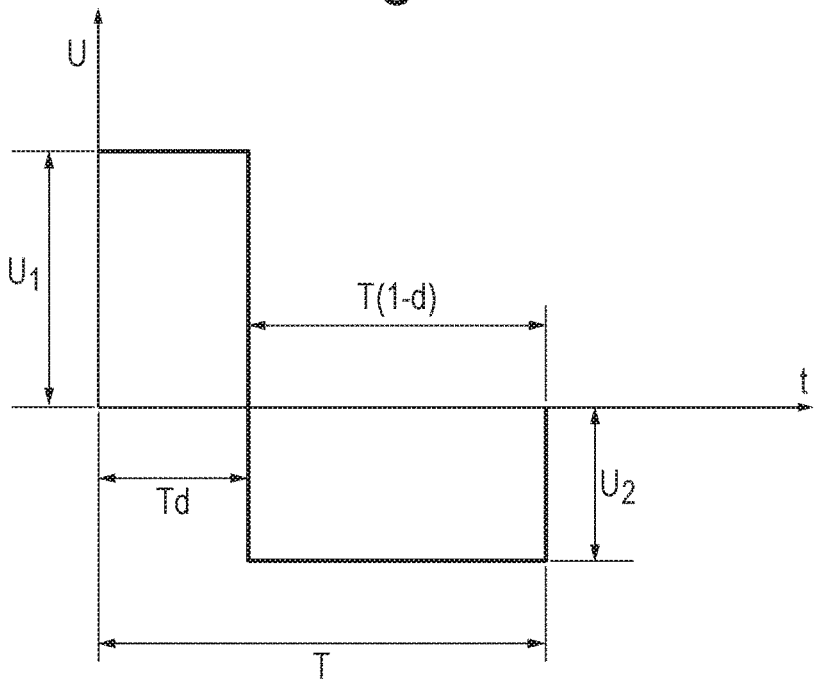
FIG. 2 shows a plot of a rectangular pulsed waveform.

FIG. 2 shows an example of a rectangular pulsed waveform that may be applied to the electrodes of a quadrupole device such as a linear ion trap, in accordance with various embodiments.

As shown in FIG. 2, for each single period T of the voltage waveform, a positive voltage $U_1$ is applied for time $T_d$, and then a negative voltage $U_2$ is applied for the remainder of the period T, i.e. for $T_{(1-d)}$. It will be understood that this is a quadrupolar voltage, e.g. such that the waveform illustrated in FIG. 2 is repeatedly applied to one pair of opposing rod electrodes of the quadrupole device of FIG. 1A, and an inverted version is repeatedly applied to the other pair of rod electrodes. It would also be possible to apply the waveform to only one of the pairs of electrodes. The waveform illustrated in FIG. 2 may be repeatedly applied to one or more of the electrodes of the quadrupole device of FIG. 1B, such as to the ring electrode.

The "duty cycle" of the waveform of FIG. 2 is defined as the proportion d of the time period T for which the positive voltage $U_1$ is applied.

Figure 3A:
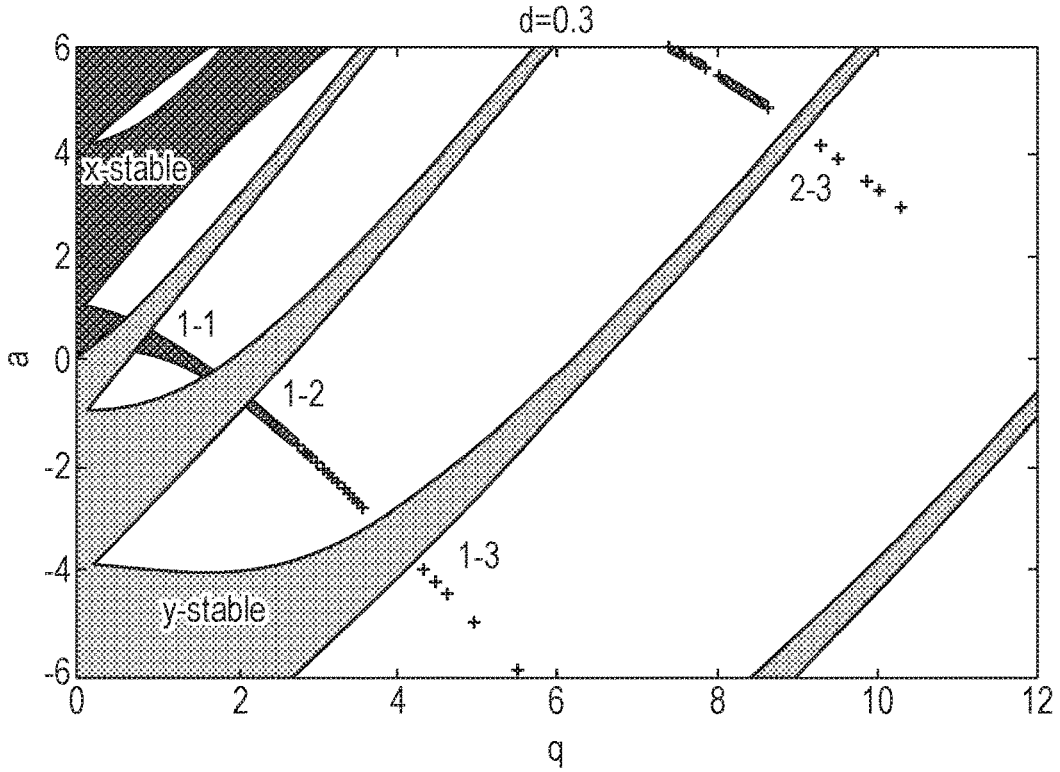
FIG. 3A shows a stability diagram for the rectangular pulsed waveform of FIG. 2 where d=0.3.
Figure 3B:
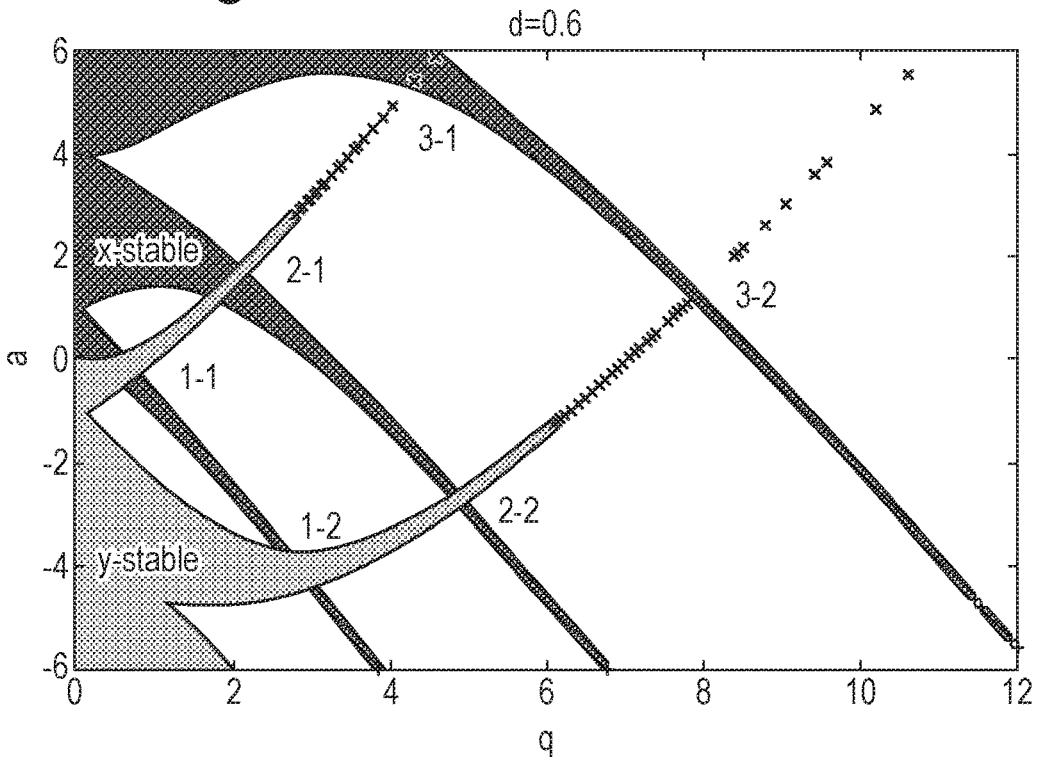
FIG. 3B shows a stability diagram for the rectangular pulsed waveform of FIG. 2 where d=0.6.

FIG. 3A shows the stability diagram for the voltage waveform of FIG. 2, where the duty cycle ratio d=0.3, and FIG. 3B shows the stability diagram for the voltage waveform of FIG. 2, where the duty cycle ratio d=0.6. Stable regions are marked on the diagrams using the notation "number of the stable band in x"-"number of stable band in y". Hence, the usual first stable region is labelled 1-1 in this notation.

The stability parameters q and a used to plot the stability diagrams are defined as:

$$q = fac \times 0.5 \times (U_1 - U_2), \text{ and}$$

$$a = fac \times (U_1 + U_2),$$

where $U_1$ and $U_2$ are the two digital pulse amplitudes (defined in FIG. 2), $fac = 4ze/(2\pi f)^2 r_0^2 m$, z is the number of charges on the ion, e is the elementary charge, f is the RF frequency, $r_0$ is the field radius of the quadruple, and m is the mass of the ion.

Figure 4:
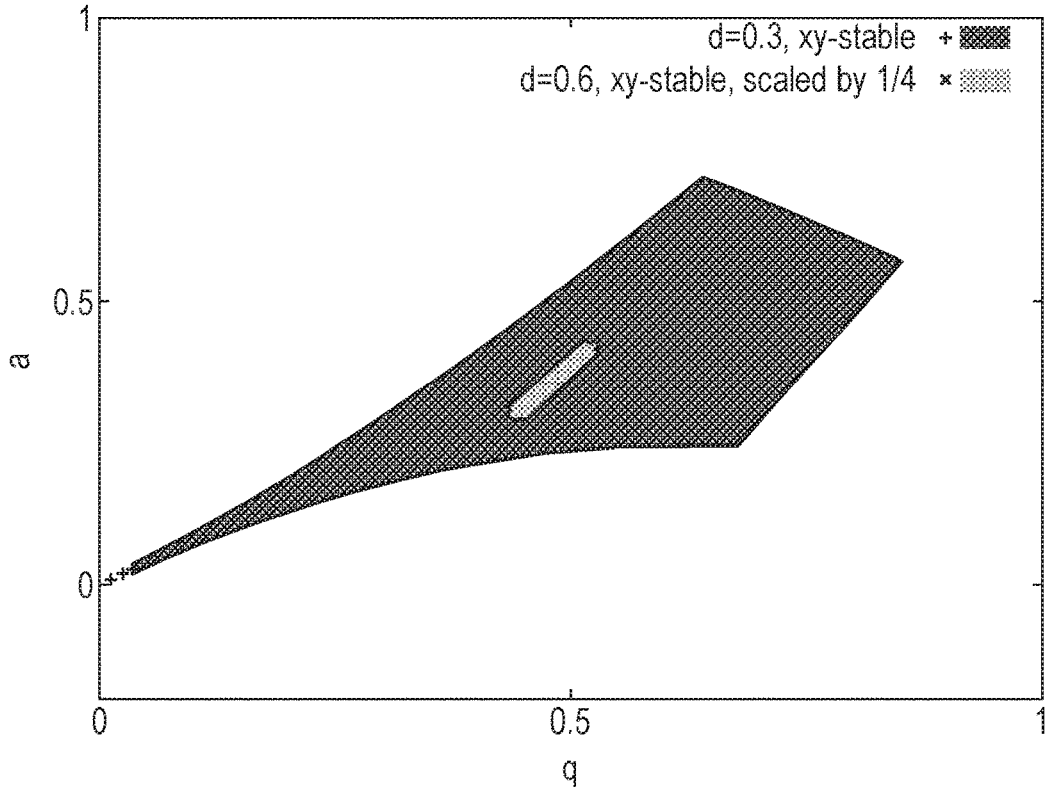
FIG. 4 shows the 1-1 stable region of the rectangular pulsed waveform where d=0.3 overlaid with the 2-1 stable region of the rectangular pulsed waveform where d=0.6 scaled by a factor of 4.

FIG. 4 shows a zoomed in view of the 1-1 stable region for the d=0.3 pulse. Overlaid on this is a plot of the 2-1 stable region for the d=0.6 waveform, with q and a scaled down by a factor of 4. It can be seen that the scaled 2-1 stable region for the d=0.6 waveform overlaps with the 1-1 stable region for the d=0.3 waveform.

The stability parameters q and a are directly related to the applied pulse voltages by a factor of $1/f^2$. Therefore if the d=0.3 pulse is compared to the d=0.6 pulse running at half the frequency, overlapping stable regions are present for identical pulse voltage values.

Considering the point q=0.48 and a=0.355 within the 1-1 stable region of the d=0.3 pulse, for a drive frequency of 1 MHz, this leads to applied pulse voltages $U_1$=191 and $U_2$=−88 for an ion having a mass of 100 (for a quadrupole field radius $r_0$=5.33 mm). The corresponding point in the 2-1 stable region for the d=0.6 waveform is at q=1.92 and a=1.42, which for a drive frequency of 0.5 MHz leads to identical applied pulse voltages.

In general, the ability to plot overlapping scaled stability regions makes it a relatively straightforward process to select initial and final q and a values that allow jumping from one stable region to another without changing the pulse voltage amplitudes. The required change in frequency is determined from the scaling factor required to produce the overlap.

FIG. 5 shows some further examples of overlapping scaled stability regions, which may be used to perform transitions between stability regions in accordance with various embodiments.

Figure 5A:
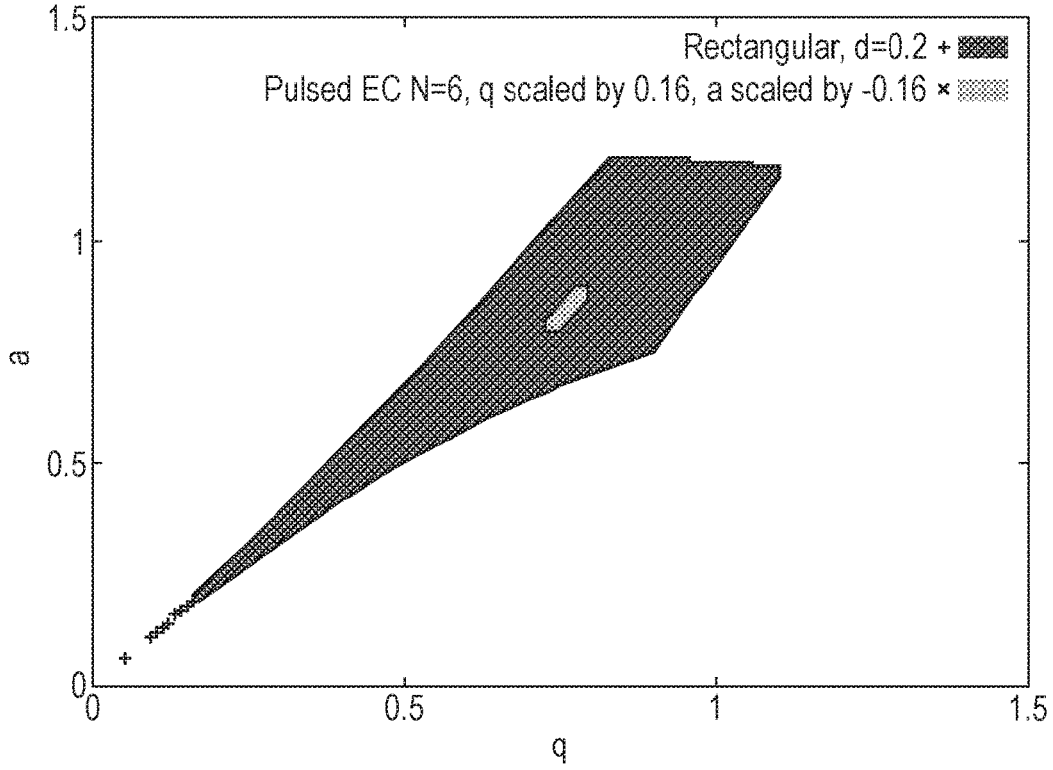
FIG. 5A shows the 1-1 stable region of the rectangular pulse waveform where d=0.2 overlaid with the 1-2 stable region of a pulsed EC waveform where N=6 scaled by a factor of 0.16 (a factor of 0.4 in frequency)

FIG. 5A shows the 1-1 stable region for a rectangular pulsed waveform where d=0.2. Overlaid on this is the 1-2 stability region for a "pulsed EC signal", where N=6, that is scaled by a factor of 0.16.

Figure 6:
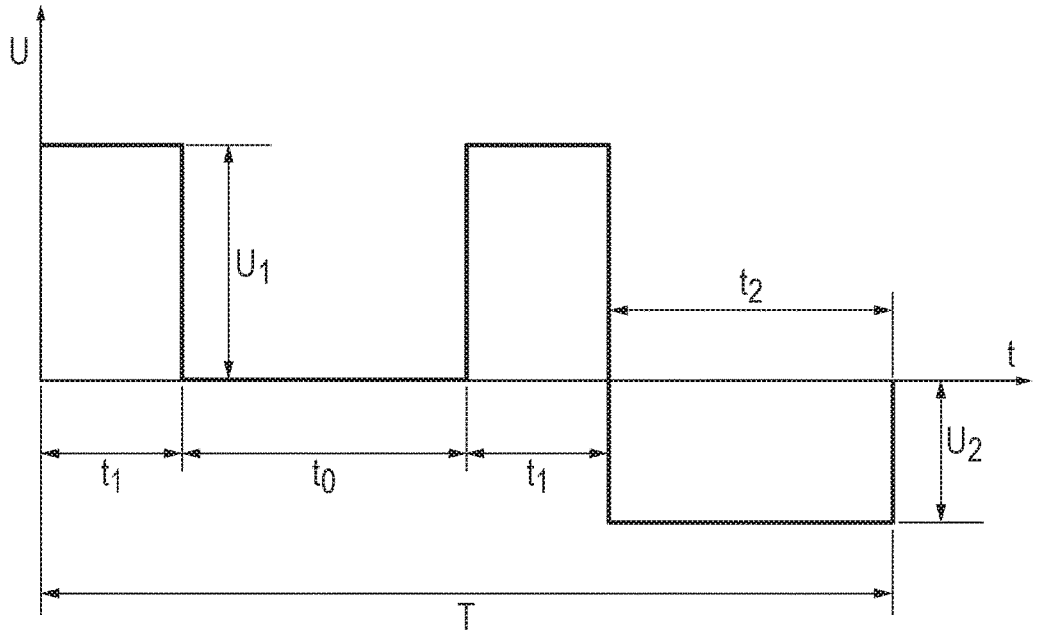
FIG. 6 shows a plot of the asymmetric pulse EC signal.

FIG. 6 shows the waveform for the pulsed EC signal. As shown in FIG. 6, in each single period T of the waveform, a first (positive) voltage $U_1$ is applied for time period $t_1$, zero volts is then applied for time period $t_0$, $U_1$ is applied again for time period $t_1$, then a second (negative) voltage $-U_2$ is applied for time $t_2$. It will again be understood that this is a quadrupolar voltage, e.g. such that the waveform illustrated in FIG. 6 is applied to one pair of opposing rod electrodes of the quadrupole device 3 of FIG. 1A, and an inverted version is applied to the other pair of rod electrodes. It would also be possible to apply the waveform to only one of the pairs of electrodes. The waveform illustrated in FIG. 6 may be repeatedly applied to one or more of the electrodes of the quadrupole device of FIG. 1B, such as to the ring electrode.

The N notation is a shorthand for the time ratios of the pulses. Thus, where the times $t_0$, $t_1$ and $t_2$ are set such that $t_1$=T/6, and $t_0$=$t_2$=2T/6, the waveform is termed the "N=6 waveform". Where the times $t_0$, $t_1$ and $t_2$ are set such that $t_1$=$t_2$=$t_0$=T/4, the waveform is termed the "N=4 waveform". Where the times $t_0$, $t_1$ and $t_2$ are set such that $t_1$=T/8, and $t_0$=$t_2$=3T/8, the waveform is termed the "N=8 waveform".

As demonstrated by FIG. 5A, if the frequency of the pulsed EC signal where N=6 is scaled by 0.4, it is possible to jump between stability regions without changing the pulse voltage amplitudes.

Figure 5B:
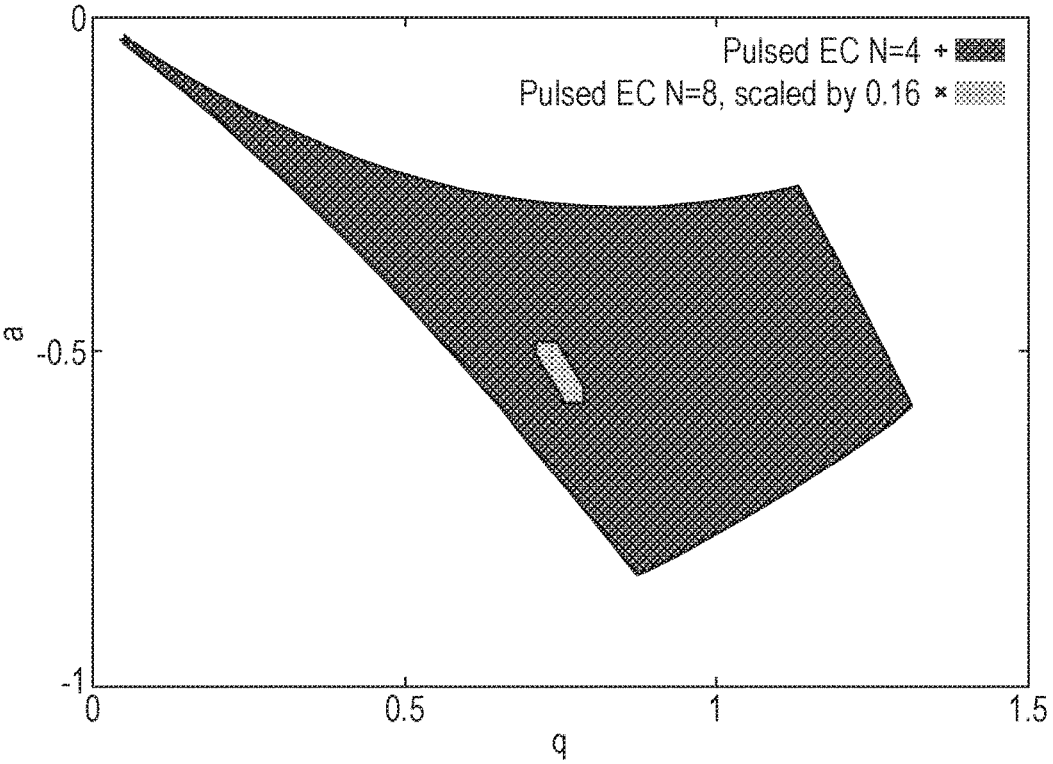
FIG. 5B shows the 1-1 stable region of a pulsed EC waveform where N=4 overlaid with the 1-2 stable region of a pulsed EC waveform where N=8 scaled by a factor of −0.16.

FIG. 5B shows the 1-1 stability region for an N=4 pulsed EC waveform, and the 1-2 stability region for an N=8 pulsed EC waveform. Here, the N=8 pulsed EC waveform has been scaled by a factor of 0.16 and additionally by a factor of −1. This effectively means that the voltage values $U_1$ and $U_2$ are swapped around and the sign is inverted. However, the two pulse voltage amplitudes $U_1$, $U_2$ remain the same. Again, FIG. 5B demonstrates that it is possible to jump between stability regions without changing the pulse voltage amplitudes.

The above examples describe possible transitions between stable regions for differing pulse waveforms where the pulse voltage amplitudes are kept constant.

In general any change of the waveform type or duty cycle will lead to a change in the stability diagram. Hence there are an almost limitless number of possible transitions between differing stable regions where the pulse voltages are kept constant in accordance with various embodiments.

Where the pulse voltages are not kept constant between the two different modes of operation, then other transitions are possible, and in general any transition may be achieved in accordance with various embodiments.

In the examples described above, rectangular and asymmetric pulsed EC signals have been used. However, the various embodiments described herein are not limited to rectangular pulses. Any waveform can be used, and may be produced or approximated by a digital pulsed waveform. Possible waveforms that may be used in accordance with various embodiments include, for example, symmetric pulsed EC signals, three phase rectangular pulses, triangular pulses, sawtooth pulses, trapezoidal pulses, etc.

Various embodiments described herein encompass any transition of the digital waveform which results in ions which are stable in an initial stability region of a quadrupolar field transitioning to be stable in a different stability region. As discussed above, the initial stable region may be the 1-1 stable region since this region generally has the highest acceptance, however different initial stable regions are possible.

As discussed above, in accordance with various embodiments, the first and second waveforms and/or their settings are selected to move ions from one stable region to another. However, stability is not guaranteed as the waveform is changed, i.e. at the transition point or time. This is because the waveform that the ions experience during the transition event may not be exactly the same as either of the first and second waveforms, e.g. the transition is (in principle) a discontinuous event. Accordingly, some loss of ions due to the transition event may occur.

Furthermore, the phase at which the first voltage waveform stops and/or at which the second voltage waveform starts can have an effect on the stability of the ions during the transition.

Accordingly, the Applicants have recognised that the point (in time) during a (single) cycle of the first voltage waveform (that is, the phase) at which the first voltage waveform is ended and/or the point (in time) during a (single) cycle of the second voltage waveform (that is, the phase) at which the second voltage waveform is started can have an effect on the stability of ions in the quadrupole device.

Accordingly, by selecting (controlling) the end phase of the first voltage waveform and/or the initial phase of the second voltage waveform, the ion retention in the quadrupole device can be further increased or maximised.

Figure 7:
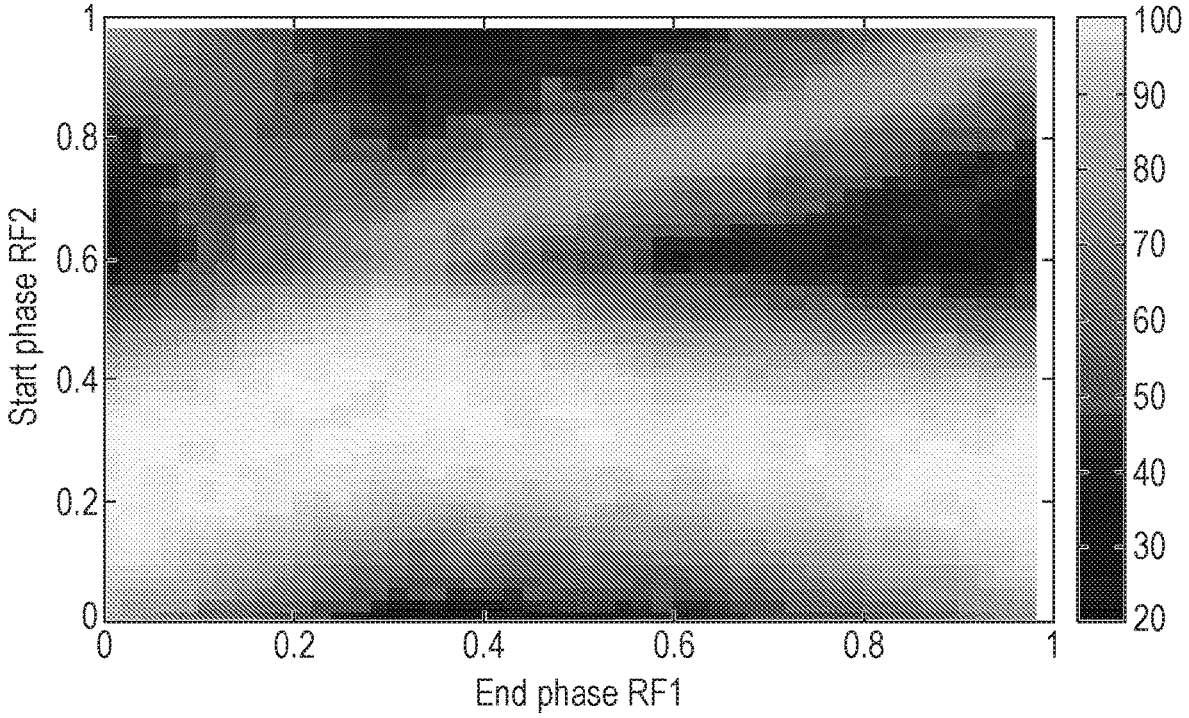
FIG. 7 shows a 2D plot of transmission percentage versus end phase of the first RF waveform and start phase of the second RF waveform, for a transition between the 1-1 stable region of the rectangular pulsed waveform where d=0.3 and the 2-1 stable region of the rectangular pulsed waveform where d=0.6 of FIG. 4.

FIG. 7 shows a heat map plot of transmission percentage for ions during the transition from the 1-1 stability region of the rectangular pulse waveform where d=0.3 to the 2-1 region of the rectangular pulse waveform where d=0.6 (described above), plotted as a function of the end phase of the first RF waveform and the start phase of the second RF waveform.

As can be seen from FIG. 7, there is significant transmission variation across the 2D space, with the start phase of the second waveform being most critical (in this example).

Thus, according to various embodiments, the end phase of the first voltage waveform and/or the start (initial) phase of the second voltage waveform is controlled (selected), e.g. so as to increase or maximise retention of ions in and/or transmission of ions through the quadrupole device, i.e. to increase or maximise the stability of ions, during the transition between the first and second modes of operation (e.g. relative to other possible values of the end phase of the first voltage waveform and/or the initial phase of the second voltage waveform). This can be done relatively straightforwardly since the waveforms can be fully controlled, e.g. using the digital voltage source 10.

The end phase of the first voltage waveform and/or the start (initial) phase of the second voltage waveform may be zero or may be greater than zero. The end phase of the first voltage waveform and/or the start (initial) phase of the second voltage waveform may be selected from the group consisting of: (i) 0-0.2π; (ii) 0.2π-0.4π; (iii) 0.4π-0.6π; (iv) 0.6π-0.8π; (v) 0.8π-π; (vi) π-1.2π; (vii) 1.2π-1.4π; (viii) 1.4π-1.6π; (ix) 1.6π-1.8π; or (x) 1.8π-2π radians.

According to various further embodiments, one or more additional waveform pulses can be added or applied during the transition period, e.g. after applying the one or more first voltages and before applying the one or more second voltages. For example, it may be beneficial to provide a relatively short time where a constant DC voltage or no pulse voltage (zero volts) is applied. This may have the effect of further increasing or maximising retention of ions in and/or transmission of ions through the quadrupole device, i.e. increasing or maximising the stability of ions, during the transition between the first and second modes of operation.

Additionally or alternatively, it may be beneficial to apply one or more focusing and/or defocusing pulses, e.g. for a relatively short time in either or both (x and/or y) axes. This may be done during the transition period, e.g. after applying the one or more first voltages and before applying the one or more second voltages. The one or more focusing and/or defocusing pulses may be arranged so as to reduce or expand the positional extent of the ion beam or ion packet in the radial direction(s) (in the x and/or y directions). This may have the effect of further increasing or maximising retention of ions in and/or transmission of ions through the quadrupole device, i.e. increasing or maximising the stability of ions, during the transition between the first and second modes of operation.

In embodiments where the techniques described herein are applied in an ion trap (e.g. 3D or linear trap) it may be beneficial to allow some cooling time before and after stability region transitions. For example, ions may be introduced to the trap in one stability region, allowed to cool, then jumped to a higher stability region, allowed to cool once more, and then e.g. analysed (by any suitable and desired method). This will have the effect of increasing ion retention within the device.

In embodiments where the techniques described herein are applied to a quadrupole mass filter, the transition may be applied while the ions are in transit through the quadrupole device. In this case, the ions may be injected in packets (although a continuous beam may be used, e.g. while accepting the loss of duty cycle). The transition may be applied once the ions have moved far enough into the quadrupole that the field is substantially identical to the 2D quadrupolar field, i.e. ions are far enough from the entrance of the quadrupole that fringing field effects are negligible. This will have the effect of increasing ion retention within the device.

It will accordingly be appreciated that various embodiments are directed to a quadrupole device such as a quadrupole ion trap, linear ion trap, or quadrupole mass filter. In operation, the device is driven with a digital pulsed waveform, ions are introduced to the device and/or generated within the device, and the initial voltage amplitude, waveform, duty cycle, and/or frequency of the drive voltage is selected such that the ions of interest (e.g. having a mass to charge ratio within a range of interest) are introduced and/or created in a first stable region of the stability diagram of the first drive voltage.

After some time one, some or all of the voltage amplitude, waveform, duty cycle, and/or frequency of the drive voltage is/are altered so as to place the ions of interest in a different stable region of the stability diagram of the second drive voltage.

According to various embodiments, the pulse voltage amplitudes may be kept constant.

According to various embodiments, the end and/or start phases of the two waveforms may be selected so as to increase or maximise transmission.

According to various embodiments, a short duration of zero applied voltage may be provided, and/or a focusing pulse or sequence of pulses may be applied, in either or both (x or y) axes.

The various embodiments described herein allow quadrupolar devices to operate in higher stability regions without the loss of transmission and/or sensitivity associated with the injection of ions into quadrupoles operating in these regions. According to various embodiments, the quadrupole device may be part of an analytical instrument such as a mass and/or ion mobility spectrometer. The analytical instrument may be configured in any suitable manner.

Figure 8:
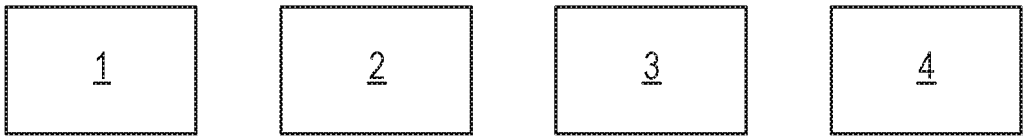
FIGS. 8-11 show schematically various analytical instruments comprising a quadrupole device in accordance with various embodiments.

FIG. 8 shows an embodiment comprising an ion source 1, an ion accumulation region 2 downstream of the ion source 1, the quadrupole device 3 (which may be in the form of a quadrupole mass filter) downstream of the accumulation region 2, and a detector 4 downstream of the quadrupole 3.

Figure 9:
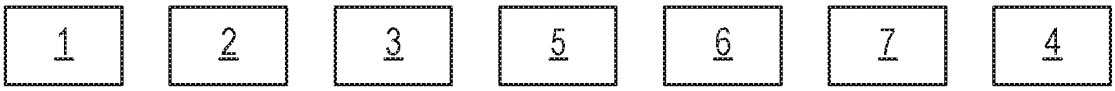

FIG. 9 shows a tandem quadrupole arrangement comprising a CID cell or other fragmentation device 5 downstream of the quadrupole device 3, a second accumulation region 6 downstream of the fragmentation device 5, and a second quadrupole 7 downstream of the second accumulation region 6.

Figure 10:
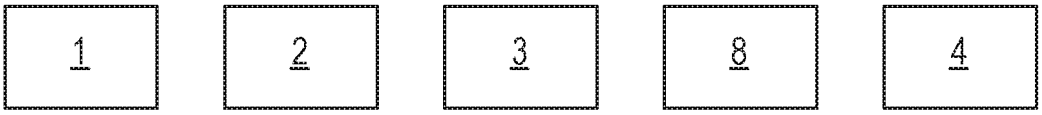

FIG. 10 shows a Quadrupole-Time-of-Flight ("Q-TOF") embodiment, comprising an orthogonal acceleration time of flight mass analyser 8 between the quadrupole device 3 and the detector 4.

According to various embodiments, ions may be stored in the accumulation region 2 prior to release as packets into the quadrupole device 3. For a high incoming ion current, there may be issues with over-filling of the accumulation region 2. Space charge effects from the trapped ions may lead to a reduction in performance of the subsequent quadrupole device 3 (e.g. due to phase space expansion), or ion losses in the accumulation region 2 itself leading to reduced sensitivity and/or mass discrimination effects.

Figure 11:
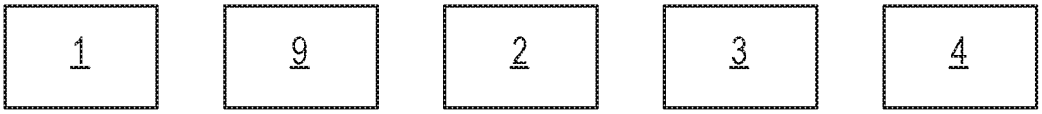

FIG. 11 shows an embodiment where a filter 9 is positioned before the accumulation region 2. The filter 9 may be used to control the level of charge in the accumulation region 2. Examples of filters in accordance with various embodiments include quadrupole mass filters, ion mobility devices, differential mobility analysis ("DMA") devices, field asymmetric-waveform ion-mobility spectrometry ("FAIMS") devices, differential mobility spectrometry ("DMS") devices, thermal ionisation mass spectrometry ("TIMS") devices, and the like.

According to various embodiments, the quadrupole device 3 as disclosed herein may be operated in other configurations, e.g. with different analysers or ion separators (for example an ion mobility separator) or dissociation devices upstream or downstream of the quadrupole device or devices.

Although the above embodiments have been described primarily in terms of applying a (single) quadrupolar voltage to the quadrupole device, it would also be possible to apply one or more additional quadrupolar and/or dipolar voltages to the quadrupole device.

As such, the one or more first and/or second voltages (and the first and/or second repeating voltage waveform) may comprise one or more quadrupolar repeating voltage waveforms, optionally together with one or more dipolar repeating voltage waveforms.

A quadrupolar repeating voltage waveform may be applied to the quadrupole device by applying the same phase of the repeating voltage waveform to opposing electrodes of the quadrupole device, and by applying opposite phases of the repeating voltage waveform to adjacent electrodes (e.g. as described above). A dipolar repeating voltage waveform may be applied to the quadrupole device by applying opposite phases of the repeating voltage waveform to (one or both) opposing pairs of electrodes of the quadrupole device (and optionally by applying the same phase of the repeating voltage waveform to pairs of adjacent electrodes).

The amplitude and/or frequency of the one or more additional quadrupolar and/or dipolar voltages may be selected as desired.

According to various embodiments, the one or more additional quadrupolar and/or dipolar voltages may have the effect of altering the stability diagram, e.g. so as to add bands of instability. The previous stable region(s) may be bisected by the bands of instability. This may lead to the (previously) stable regions splitting into multiple smaller stable regions, i.e. numerous smaller "islands of stability".

The Applicants have found that there are benefits, e.g. in terms of the peak shape and/or speed of ion ejection, associated with operating the quadrupole device within such stability islands (e.g. that may be formed from the former first stability region or higher order stability regions).

Thus, according to various embodiments, the quadrupole device may be operated as described above, but where operating the quadrupole device in the second (and/or first) mode of operation comprises applying one or more additional quadrupolar and/or dipolar waveforms to the quadrupole device.

Figure 12A:
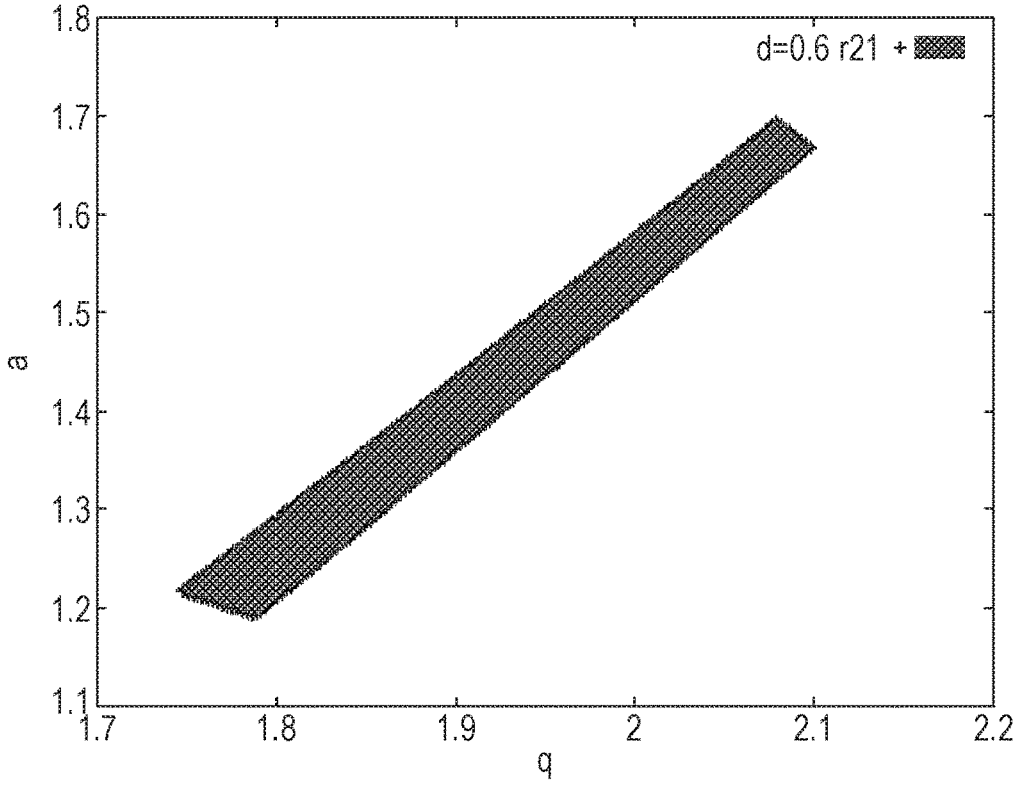
FIG. 12A shows the 2-1 stable region for the rectangular pulsed waveform with d=0.6.
Figure 12B:
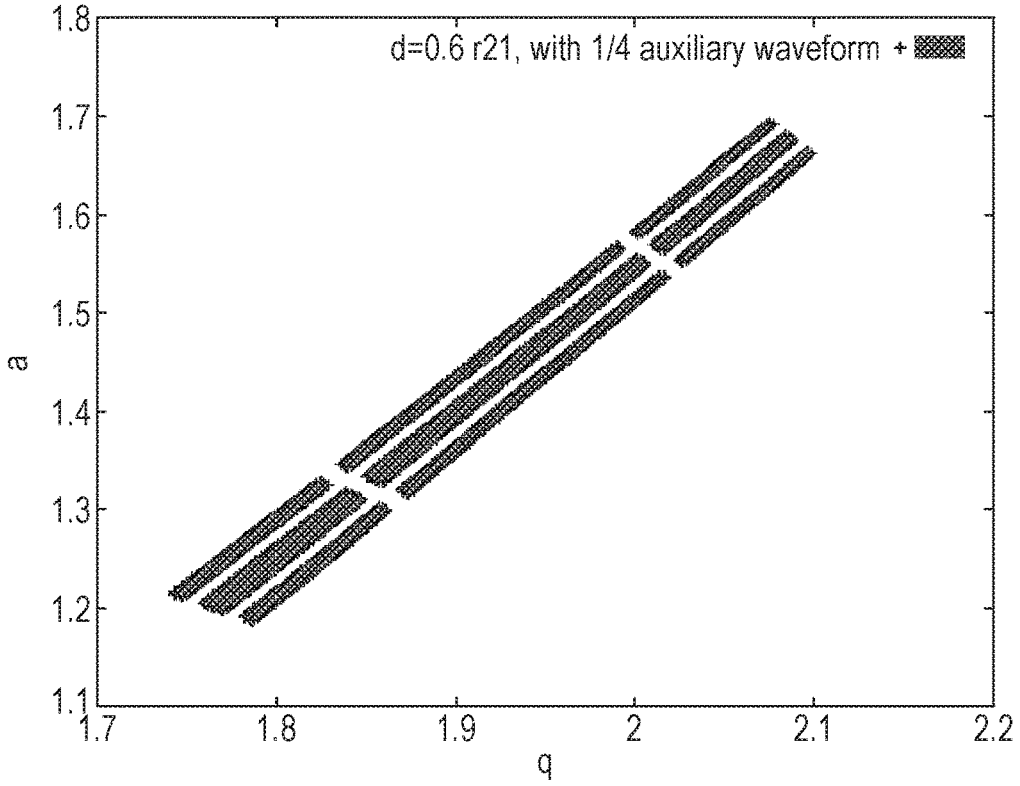
FIG. 12B shows the 2-1 stable region for the rectangular pulsed waveform with d=0.6 with an additional quadrupolar waveform applied at ¼ of the main waveform frequency (voltage amplitude=0.01 q).

FIG. 12A shows the 2-1 stable region for the rectangular pulsed waveform with d=0.6. FIG. 12B shows the 2-1 stable region for the rectangular pulsed waveform with d=0.6 with an additional quadrupolar waveform applied at ¼ of the main waveform frequency (voltage amplitude=0.01 q). It can be seen that the previous stable region (shown in FIG. 12A) fragments into multiple smaller stability regions or islands.

As described above, FIG. 4 demonstrates a stability region jump from the first stable region for a rectangular pulsed waveform with d=0.3 into the 2-1 stable region (as shown in FIG. 12A). A corresponding jump can be performed to place ions into one of the stable islands formed in the 2-1 stable region shown in FIG. 12B.

Additional dipolar excitations may also or instead be used to cause modification(s) to the stability diagram. When an additional dipolar waveform is applied, bands of instability are added in one axis (x or y) only. Calculation of stability diagrams for systems with dipolar excitation is not formally possible as the field is no longer purely quadrupolar. However numerical methods can be used to generate an "effective" stability diagram.

Thus, according to various embodiments, one or more additional quadrupolar and/or dipolar waveforms may be applied in the second mode of operation. The one or more additional quadrupolar and/or dipolar waveforms may have the effect of introducing one or more instability bands into the stability diagram.

Although the above embodiments have been described primarily in terms of applying a digital drive voltage, according to various embodiments, the techniques described herein may be used with a resonantly driven quadrupole device, e.g. where one or more RF voltages together with one or more DC offset voltages are applied to the electrodes of the quadrupole device.

Although the present invention has been described with reference to preferred embodiments, it will be understood by those skilled in the art that various changes in form and detail may be made without departing from the scope of the invention as set forth in the accompanying claims.

The invention claimed is:

1. A method of operating a quadrupole device comprising:

operating the quadrupole device in a first mode of operation; and operating the quadrupole device in a second mode of operation;

wherein operating the quadrupole device in the first mode of operation comprises applying one or more first voltages to the quadrupole device such that the quadrupole device is operated in an initial stability region and such that at least some ions are stable within the quadrupole device;

wherein operating the quadrupole device in the second mode of operation comprises applying one or more second voltages to the quadrupole device such that the quadrupole device is operated in a different order stability region and such that at least some of the ions that were stable within the quadrupole device in the first mode of operation are stable within the quadrupole device in the second mode of operation; and wherein the quadrupole device is switched from the first mode of operation to the second mode of operation while said at least some of the ions within the quadrupole device maintain stable trajectories and are retained within the quadrupole device.

2. A method as claimed in claim 1, further comprising passing ions into the quadrupole device and/or generating ions in the quadrupole device when the quadrupole device is operated in the first mode of operation.

3. A method as claimed in claim 1, wherein the one or more first and/or second voltages comprises one or more digital drive voltages.

4. A method as claimed in claim 1, wherein:

the one or more first voltages comprise a first repeating voltage waveform having one or more first amplitudes, a first frequency, a first shape and/or a first duty cycle;

the one or more second voltages comprise a second repeating voltage waveform having one or more second amplitudes, a second frequency, a second shape and/or a second duty cycle; and one or more or all of the first and second amplitudes, the first and second frequencies, the first and second shapes, and the first and second duty cycles are different.

5. A method as claimed in claim 1, wherein:

the one or more first voltages comprise a first repeating voltage waveform having one or more first amplitudes;

the one or more second voltages comprise a second repeating voltage waveform having one or more second amplitudes; and one or more of the first and second amplitudes are substantially the same.

6. A method as claimed in claim 1, wherein:

the one or more first voltages comprise a first repeating voltage waveform; and a phase of the first voltage waveform at which the one or more first voltages are ended is selected in order to increase ion retention in and/or ion transmission through the quadrupole device.

7. A method as claimed in claim 1, wherein:

the one or more second voltages comprise a second repeating voltage waveform; and a phase of the second voltage waveform at which the one or more second voltages are initiated is selected in order to increase ion retention in and/or ion transmission through the quadrupole device.

8. A method as claimed in claim 1, further comprising applying one or more constant DC voltages, one or more focussing pulses, and/or one or more defocussing pulses to the quadrupole device after applying the one or more first voltages and before applying the one or more second voltages.

9. A method as claimed in claim 1, wherein the different order stability region is a higher order stability region than the initial stability region.

10. A method as claimed in claim 1, wherein the quadrupole device comprises a quadrupole ion trap, a linear ion trap or a quadrupole mass filter.

11. A method as claimed in claim 1, wherein the one or more first and/or second voltages comprises one or more quadrupolar repeating voltage waveforms, optionally together with one or more dipolar repeating voltage waveforms.

12. An apparatus comprising:

a quadrupole device; and a control system;

wherein the control system is configured:

(i) to operate the quadrupole device in a first mode of operation; and (ii) to operate the quadrupole device in a second mode of operation;

wherein the control system is configured to operate the quadrupole device in the first mode of operation by applying one or more first voltages to the quadrupole device such that the quadrupole device is operated in an initial stability region and such that at least some ions are stable within the quadrupole device; and wherein the control system is configured to operate the quadrupole device in the second mode of operation by applying one or more second voltages to the quadrupole device such that the quadrupole device is operated in a different order stability region and such that at least some of the ions that were stable within the quadrupole device in the first mode of operation are stable within the quadrupole device in the second mode of operation; and wherein the control system is configured to switch the quadrupole device from the first mode of operation to the second mode of operation while said at least some of the ions within the quadrupole device maintain stable trajectories and are retained within the quadrupole device.

13. An apparatus as claimed in claim 12, wherein the control system is configured to cause ions to be passed into the quadrupole device and/or to cause ions to be generated in the quadrupole device when the quadrupole device is operated in the first mode of operation.

14. An apparatus as claimed in claim 12, wherein the one or more first and/or second voltages comprises one or more digital drive voltages.

15. An apparatus as claimed in claim 12, wherein:

the one or more first voltages comprise a first repeating voltage waveform having one or more first amplitudes, a first frequency, a first shape and/or a first duty cycle;

the one or more second voltages comprise a second repeating voltage waveform having one or more second amplitudes, a second frequency, a second shape and/or a second duty cycle; and one or more or all of the first and second amplitudes, the first and second frequencies, the first and second shapes and the first and second duty cycles are different.

16. An apparatus as claimed in claim 12, wherein:

the one or more first voltages comprise a first repeating voltage waveform having one or more first amplitudes;

the one or more second voltages comprise a second repeating voltage waveform having one or more second amplitudes; and one or more of the first and second amplitudes are substantially the same.

17. An apparatus as claimed in claim 12, wherein:

the one or more first voltages comprise a first repeating voltage waveform; and a phase of the first voltage waveform at which the one or more first voltages are ended is selected in order to increase ion retention in and/or ion transmission through the quadrupole device.

18. An apparatus as claimed in claim 12, wherein:

the one or more second voltages comprise a second repeating voltage waveform; and a phase of the second voltage waveform at which the one or more second voltages are initiated is selected in order to increase ion retention in and/or ion transmission through the quadrupole device.

19. An apparatus as claimed in claim 12, wherein the different order stability region is a higher order stability region than the initial stability region.

20. An apparatus as claimed in claim 12, wherein the quadrupole device comprises a quadrupole ion trap, a linear ion trap or a quadrupole mass filter.

* * * * *